US007427001B1

(12) United States Patent
Keitges

(10) Patent No.: US 7,427,001 B1
(45) Date of Patent: Sep. 23, 2008

(54) TEMPERATURE RETAINING FOOD CONTAINER

(76) Inventor: James M. Keitges, 9529 Davenport St., Omaha, NE (US) 68114

( * ) Notice: Subject to any disclaimer, the term of this patent is extended or adjusted under 35 U.S.C. 154(b) by 110 days.

(21) Appl. No.: 11/409,642

(22) Filed: Apr. 24, 2006

Related U.S. Application Data

(62) Division of application No. 10/632,498, filed on Aug. 1, 2003, now abandoned.

(51) Int. Cl.
*A47J 41/00* (2006.01)
*A47G 23/04* (2006.01)
*B65D 6/10* (2006.01)
*B65D 8/06* (2006.01)

(52) U.S. Cl. ..... 220/574.2; 220/4.24; 220/592.28

(58) Field of Classification Search ..... 220/720–722, 220/62.18, 62.12, 62.13, 574, 574.2, 574.3, 220/592.28, 592.23, 592.17, 4.24, 575
See application file for complete search history.

(56) References Cited

U.S. PATENT DOCUMENTS 2,683,974 A * 7/1954 Brown ..... 220/574.2
2,782,782 A * 2/1957 Taylor ..... 126/374.1
2,989,207 A * 6/1961 Clar et al. ..... 220/629
3,092,277 A * 6/1963 Brim ..... 215/12.1
3,413,820 A * 12/1968 Paquin ..... 62/371
4,296,728 A * 10/1981 Hofstetter ..... 126/376.1
5,052,369 A * 10/1991 Johnson ..... 126/400
5,125,391 A * 6/1992 Srivastava et al. ..... 126/246
5,231,850 A * 8/1993 Morris ..... 62/457.6
5,642,831 A * 7/1997 Lynd ..... 220/8
5,701,757 A * 12/1997 Heverly ..... 62/457.2
6,050,443 A * 4/2000 Tung ..... 220/592.17
6,883,673 B1 * 4/2005 Gourley ..... 220/4.24

* cited by examiner

*Primary Examiner*—Anthony D Stashick
*Assistant Examiner*—Niki M. Eloshway
(74) *Attorney, Agent, or Firm*—Thomte Patent Law Office; Dennis L. Thomte

(57) ABSTRACT

A temperature-retaining food container includes an outer shell having an inner chamber that can be filled with a temperature storing medium. The shell is shaped to provide an expansion zone within the chamber to permit expansion of the medium. A support is formed to provide additional volume to the chamber and the expansion zone. The support structure can optionally be provided to automatically expand in response to an increase in pressure within the chamber. A lid is provided which covers the container and further operates as a serving platter. The shell of the container can optionally be formed from a plurality of separate portions, which interlock to form the complete serving container and disassemble for storage or use with smaller or crowded appliances.

14 Claims, 5 Drawing Sheets

TEMPERATURE RETAINING FOOD CONTAINER

CROSS-REFERENCE TO RELATED APPLICATION

This is a divisional application of Petitioner's earlier application Ser. No. 10/632,498 filed Aug. 1, 2003, entitled "TEMPERATURE RETAINING FOOD CONTAINER".

BACKGROUND OF THE INVENTION

The present invention relates to containers for holding and transporting food at a select temperature above or below the ambient temperature, and more particularly to food containers having a temperature storing medium disposed within a chamber that is shaped and sized to prevent the rupture of the chamber upon expansion of the medium.

DESCRIPTION OF THE PRIOR ART

Food containers such as bowls and platters are frequently used to transport and/or serve food items for consumption at parties and different meals. Oftentimes the food held by these containers must be served at a temperature above or below the ambient temperature. Although it is possible to place chilled or heated food within a standard container and then transport and/or serve the same, maintaining the food at its lowered or elevated temperature is difficult.

Several prior art food container designs have incorporated a temperature storing medium, such as water, crystalline wax, or various thermoplastic gel materials within a chamber disposed beneath the upper surface of the food container. This temperature storing medium can typically be heated or cooled prior to transporting or serving the food in order to keep the food within a desired temperature range. However, these systems suffer from a number of disadvantages. First, the manufacturer must select an appropriate temperature storing medium, which may be costly to obtain and difficult to seal within the container such that the temperature storing medium may expand and contract with the temperature changes. Additionally, the weight added to the overall system by including the temperature storing medium within the container greatly increases the overall weight of the system, thus increasing shipping costs.

Other prior art containers have been developed that permit the user to fill an inner chamber of the container with the temperature storing medium selected by the manufacturer. These containers also suffer from a number of deficiencies. First, this type of container typically provides a "fill line" disposed along the side of the container to provide the user with a reference point when filling the inner chamber with the temperature storing medium. When the user inadvertently fills the chamber beyond the fill line and then later heats or freezes the container, the temperature storing medium within the chamber expands beyond the capacity of the chamber and ruptures the shell of the container. Furthermore, this type of container is typically designed for use with only specific types of temperature storing media, providing the user with little choice in the matter. Regardless of the type of temperature storing medium, this type of container also suffers from poor methods of sealing off the inner chamber to prevent the medium from escaping from within the chamber during use.

Regardless of the type of container used, most prior art containers typically do not employ a lid for covering the food held within the container. Those containers that do provide a lid do not provide a lid having its own inner chamber that can be filled with a temperature storing medium, allowing the top portions of the food to exchange its lowered or heightened temperature with the environment faster than the lower portions of the food. Moreover, the lids that may be provided with prior art containers typically serve only the purpose of a cover for the container and are not easily adapted for use as a serving platter. Accordingly, multiple containers and platters of different configurations, some of which, if not all, having their own lids, are required in these situations.

Oftentimes when a large assortment or volume of food is desired, a large serving platter is best suited for transporting and/or serving the food. However, none of the prior art containers that incorporate a temperature storing medium are both large enough to fit the intended purpose and small enough to be disposed within a freezer (especially a freezer from a side-by-side refrigeration unit), a microwave or a small oven. Accordingly, a plurality of smaller to medium-sized containers must be used if the user is unable to derive a novel way of cooling or heating the large container.

Accordingly, what is needed is a novel design for a food container that uses a temperature storing medium for keeping food cool or warm, while remaining simple in design, adaptable for a plurality of uses, and capable of being cooled or heated in small appliances.

SUMMARY OF THE INVENTION

The food container of the present invention is generally provided with a shell member having inner and outer portions. The inner portion is preferably shaped to face upward and support various types of food. The outer portion is substantially spaced apart from the inner portion to define a chamber for holding a temperature storing medium. The container is adapted for use with a plurality of different temperature storing media. The shell is shaped to define an expansion zone within the chamber that is sized and shaped to receive expanded portions of the temperature storing medium caused by a change in temperature.

In a preferred embodiment, an opening is formed within the shell so that a temperature storing medium can be inserted within, or removed from, the chamber. The opening is preferably located at a position in the shell which substantially prevents the user from filling the expansion zone with the temperature storing medium when the medium is being inserted into the chamber. Another preferred embodiment forms a support member as a part of the outer portion of the shell. The support member provides a base on which the container can sit on a table or counter. The support structure is formed to provide an added volume to the chamber. In a preferred embodiment, the opening is positioned with respect to the support structure such that a substantial portion of the expansion zone is provided by the added volume supplied by the support structure. In one embodiment, the support structure is provided with accordion-shaped sides, which automatically expand in response to an increase of pressure within the chamber.

A lid is provided for covering the container. The lid is preferably provided with a temperature storing medium disposed within an inner chamber. In one embodiment, the lid is reversible so that a lower surface of the lid becomes a serving platter for a portion of the food. One or more depressions can be formed in the lid to provide receptacles for food or smaller food containers. These same depressions are also optionally formed in the inner portion of the shell of the container in alternate embodiments.

In a preferred embodiment, the shell of the container is formed from a plurality of separate shell portions having mating surfaces that interlock with one another for assembly of the complete container. The separate portions are releasably coupled with one another, allowing the user to more easily cool or heat the container in appliances having limited or awkward available space.

Accordingly, it is one of the principal objects of the present invention to provide a novel food container utilizing a temperature storing medium to keep the temperature of food above or below the ambient temperature.

A further object of the present invention is to provide a food container having a temperature storing medium disposed within a chamber having an expansion zone to prevent expansion of the medium beyond the pressure limits of the chamber.

Still another object of the present invention is to provide a food container having an opening for inserting and removing a temperature storing medium within or from a chamber within the container.

Yet another object of the present invention is to provide a food container having an inner chamber that cannot be inadvertently filled beyond an expansion capacity with any type of temperature storing medium.

Still another object of the present invention is to provide a food container that is separable into a plurality of separate portions, each having an inner chamber for holding a temperature storing medium.

A further object of the present invention is to provide a food container with a lid having an inner chamber that holds temperature storing media.

Yet another object of the present invention is to provide a food container having a lid that is reversible to use as a serving tray.

Still another object of the present invention is to provide a food container having a chamber that can be filled with a temperature storing medium that is simple to manufacture and use.

These and other objects will be apparent to those skilled in the art.

DESCRIPTION OF THE PREFERRED EMBODIMENT

Figure 1:
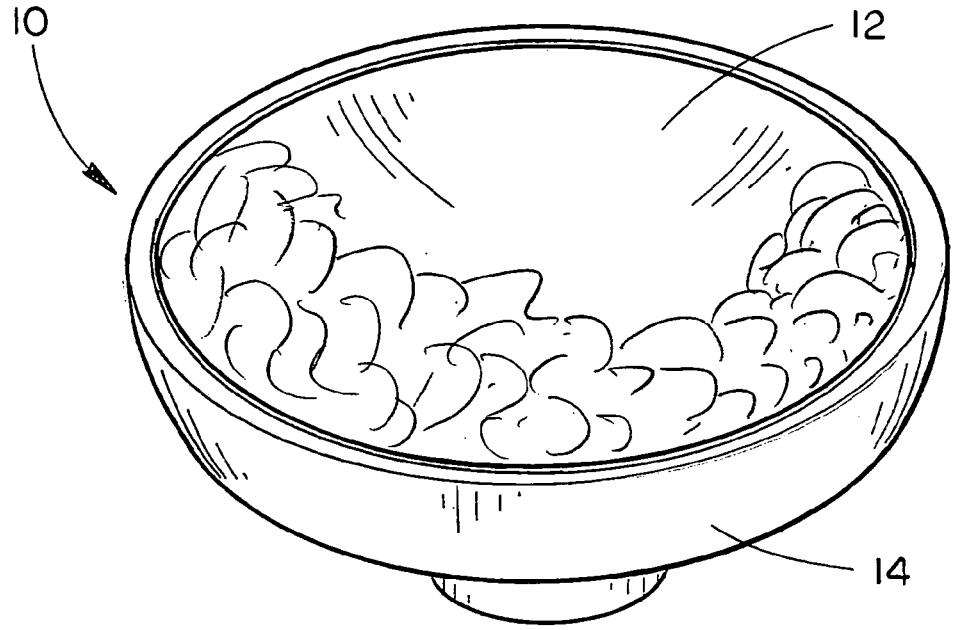
FIG. 1 is a perspective view of one embodiment of the food container of the present invention.

The food container 10, as generally depicted in FIGS. 1-11, is provided with a shell having an inner portion 12 and an outer portion 14. The inner portion 12 and the outer portion 14 are preferably secured to one another about their peripheral end portions and spaced apart from one another to form a chamber 16 therebetween. The chamber 16 has a volume that may be at least substantially filled with nearly any temperature storing medium 18, such as water, crystalline wax, thermoplastic gels, grain hulls or various synthetic and natural particulate matter. It is merely desirable that the temperature storing medium be one that is capable of retaining heat and cold for an extended period of time. Although it is contemplated that the chamber 16 could be permanently sealed after the temperature storing medium 18 has been inserted, it is preferred that an opening 20 be provided so that the user may insert or remove the temperature storing medium 18 as desired.

Although the cap means 26, for selectively closing and sealing the opening 20, is depicted in FIGS. 3-8 as being a bolt-like member, it is contemplated that other structures could be used. For example, a common threaded cap, such as that depicted in FIGS. 9 and 10, or the recessed plug member depicted in FIG. 11, could be used. Other structures could be implemented; however, it is desirable for the cap means 26 to close the opening 20 in a simple and convenient manner.

Figure 3:
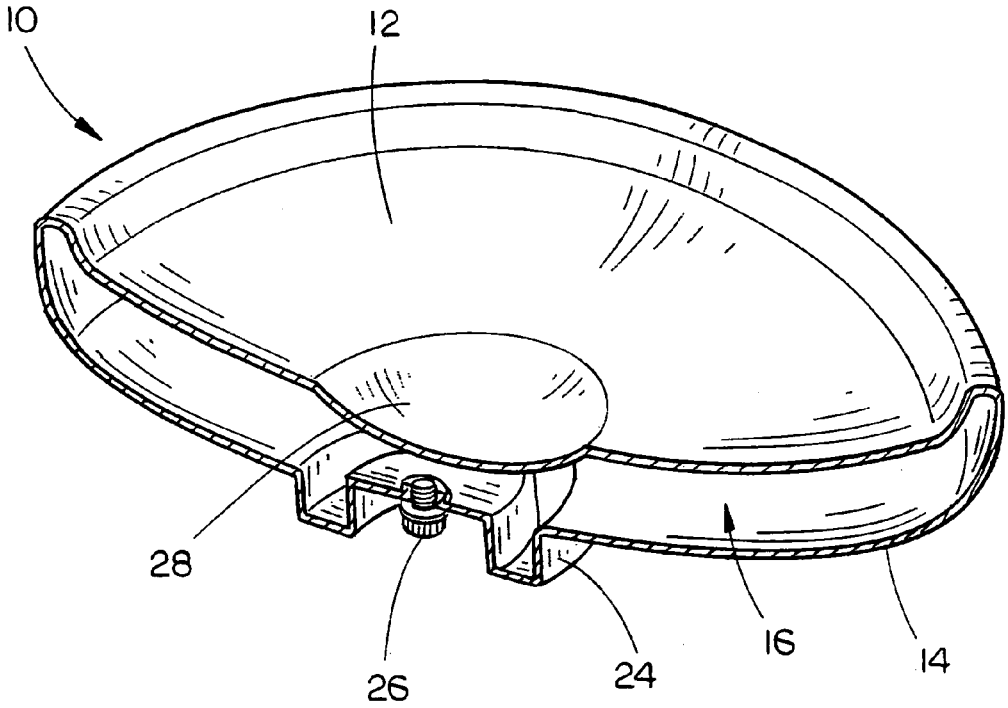
FIG. 3 is a cutaway perspective view of the food container of FIG. 2.
Figure 4:
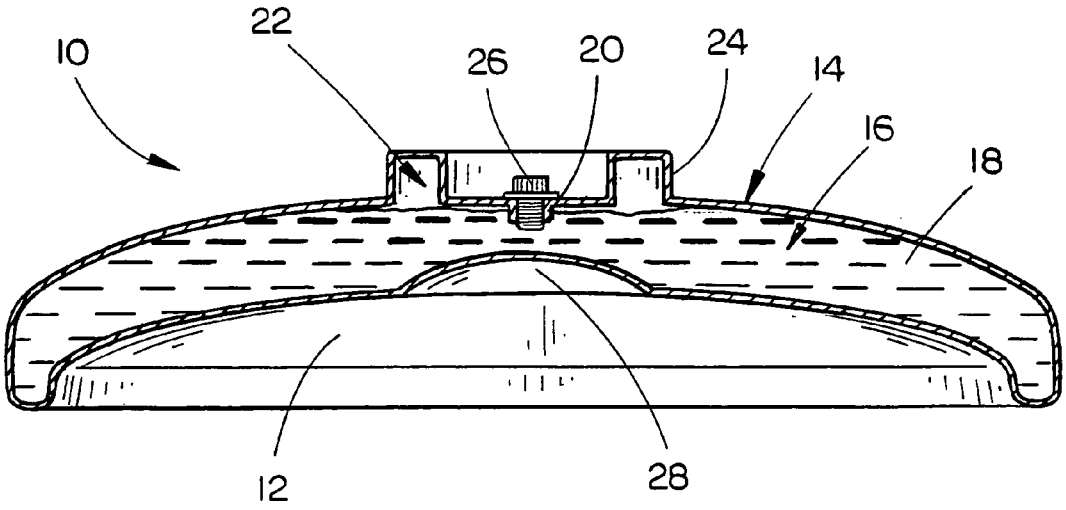
FIG. 4 is a cutaway side elevation view of the food container of FIG. 2 as the same may be substantially filled with a temperature storing medium.
Figure 6:
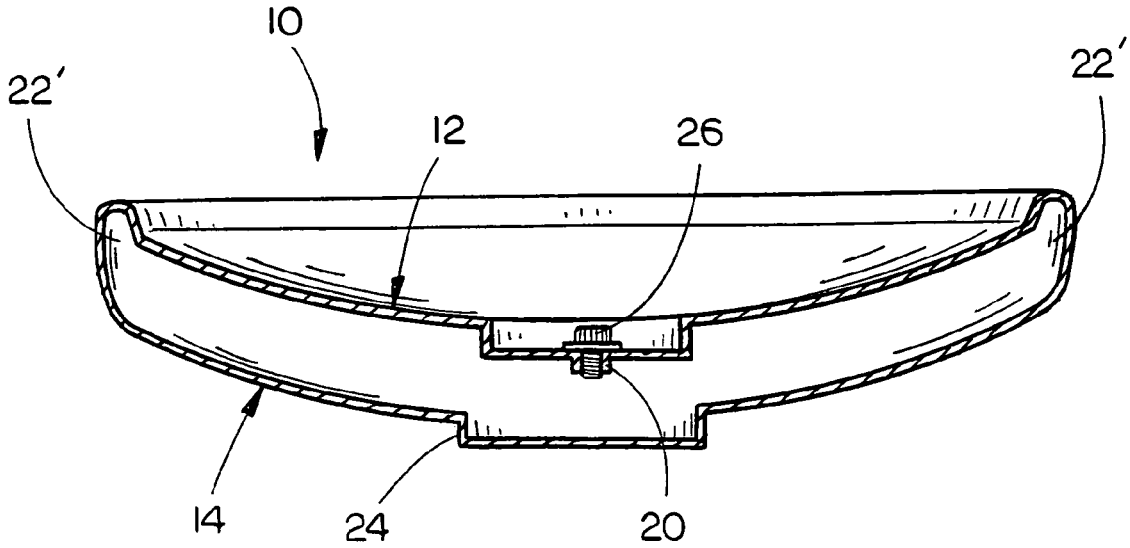
FIG. 6 is a cutaway side elevation view of an alternate embodiment of the food container of the present invention.

It is preferred that the shell be shaped and sized to provide an expansion zone 22 that remains substantially devoid of the temperature storing medium 18 until the chamber 16 has been filled with the temperature storing medium 18 and the opening 20 has been closed. This will provide an area in which the temperature storing medium 18 may expand when it is cooled or heated. In one preferred embodiment, the outer portion 14 of the shell can be shaped to have a support structure 24 that extends outwardly from the shell and provides a base on which the container 10 can rest on a table, counter or other operating surface. The support structure 24 preferably adds volume to the chamber 16. The added volume can be oriented to provide an area for the expansion zone 22. Although the support 24 depicted in FIGS. 3 and 4 is shown as being a generally annular support having a narrow diameter, it is contemplated that the support could be formed to take nearly any shape and have nearly any size. It is further contemplated that a plurality of individual supports could be formed to extend from the outer portion 14 of the shell. In another embodiment, the shell could be formed so that an expansion zone 22' is formed adjacent the inner portion 12 of the shell, or adjacent the peripheral edge of both the inner portion 12 and outer portion 14, as depicted in FIG. 6.

Wherever it is desired to locate the expansion zone 22, it is preferred that the location of the opening 20 correspond to the desired location of the expansion zone 22. For example, as depicted in FIG. 4, the opening 20 is positioned within the outer portion 14 of the shell, adjacent but below the level of the expansion zone 22. In this position, it will be difficult, if not impossible, for the user to fill the chamber 16 completely full, regardless of the angle at which the user pours the temperature storing medium 18 through the opening 20. Likewise, in FIG. 6, the expansion zone 22' is located adjacent the peripheral edge of the inner portion 12 of the shell, and the opening 20 is formed through the inner portion 12 of the shell below the level of the expansion zone 22'. Again, it will be difficult for the user to insert more of the temperature storing medium 18 than would be desired. It is contemplated that, without the expansion zone 22, the chamber 16 could be inadvertently filled to capacity with the temperature storing medium 18; and, upon freezing or overheating of the temperature storing medium 18, the shell could rupture.

Figure 7:
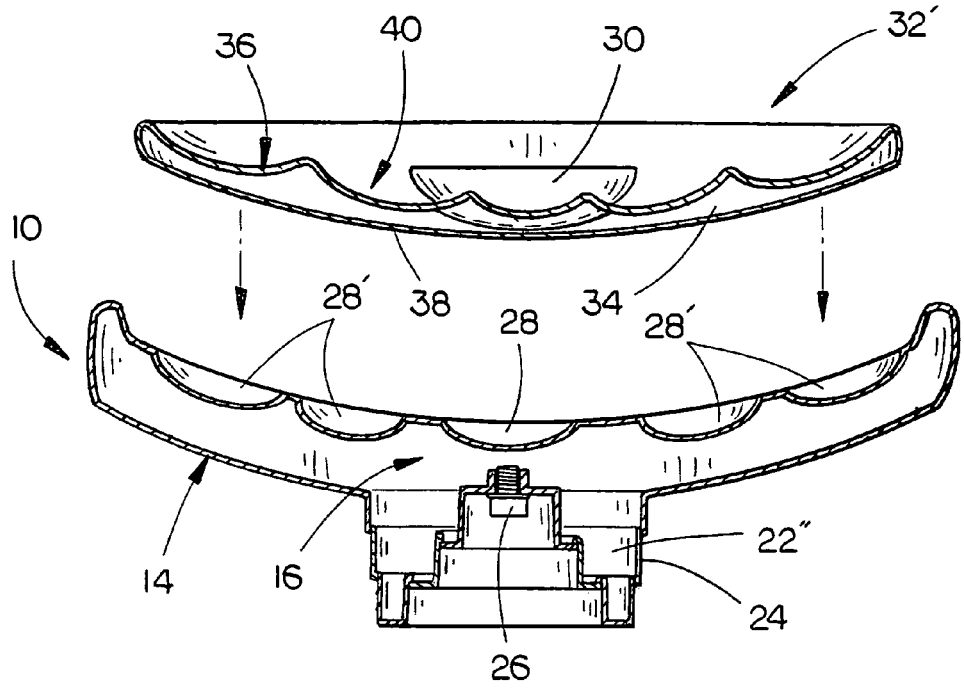
FIG. 7 is a cutaway side elevation view of an alternate embodiment of the food container and lid/tray of the present invention in a service configuration.
Figure 8:
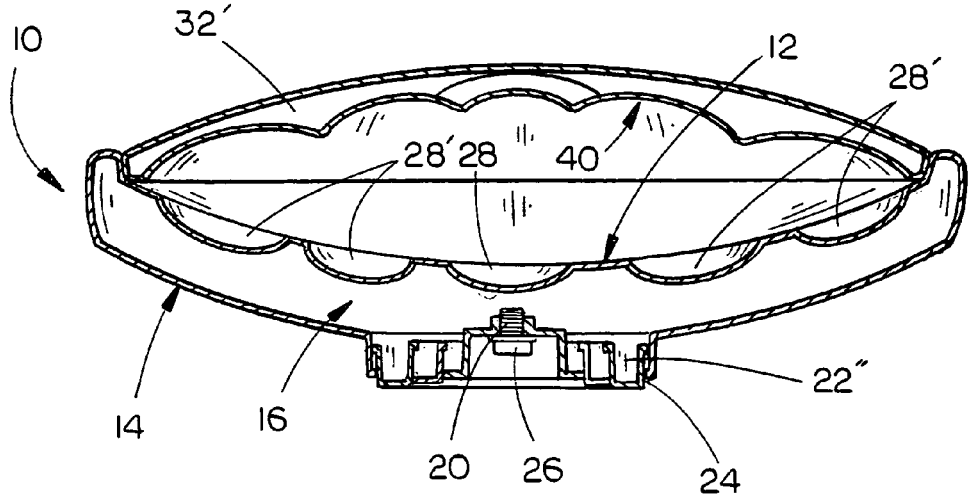
FIG. 8 depicts the food container and lid/tray of FIG. 7 in a storing or transport configuration.

In an alternate embodiment, depicted in FIGS. 7 and 8, the support 24' could be formed to be expandable in nature. As depicted, support 24' is generally provided with accordion-shaped sides that can be selectively collapsed and expanded. FIG. 7 depicts the support 24' in a fully extended position, whereas FIG. 8 depicts the support 24' in a fully collapsed position. It is intended that the expandable portion of the shell provide an expansion zone 22", which serves to provide an enlarged area for the expanding temperature storing medium 18 when necessary. It is contemplated that only a portion of the support 24' could be accordion-shaped (i.e., the innermost or outermost walls only) to achieve an expansion zone 22". Regardless of the specific configuration, the inclusion of the expanding shell portion greatly limits the reliance on accurate placement of the opening 20 in preventing the unintentional overfilling of the chamber 16. For example, if a user were to fill the chamber 16, depicted in FIG. 8, to its capacity, the temperature storing medium 18 could still expand into the support 24' by expanding the support 24' in the manner depicted in FIG. 7.

Figure 2:
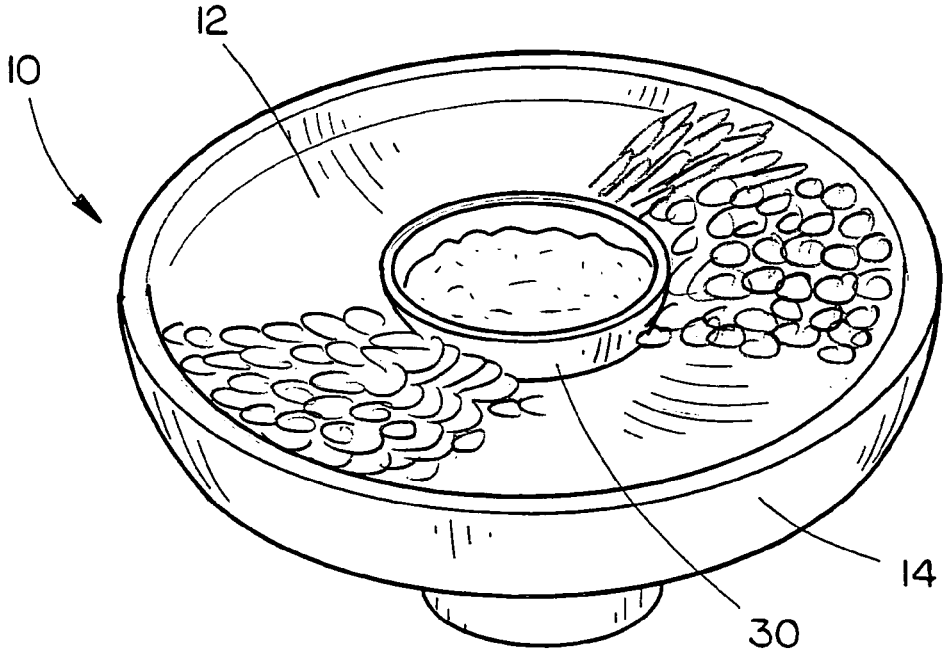
FIG. 2 is a perspective view of another embodiment of the food container of the present invention.

The inner portion 12 of the shell may be shaped to have one or more depressions 28 formed therein, as depicted in FIGS. 3, 4, 5, 7 and 8. It is contemplated that the depression 28 depicted in FIGS. 3-5 could be used to hold any food matter directly, such as vegetables or a semi-liquid food, such as a dip. However, it is also contemplated that the depression 28 could be formed to have a shape and size that would accommodate the shape and size of a bowl 30, as depicted in FIG. 2. It is contemplated that the depression 28 could be sized to accommodate a portion or all of the size of the bowl 30. As depicted in FIGS. 7 and 8, a plurality of depressions 128' could be formed within the inner portion 12 for similar purposes.

Figure 5:
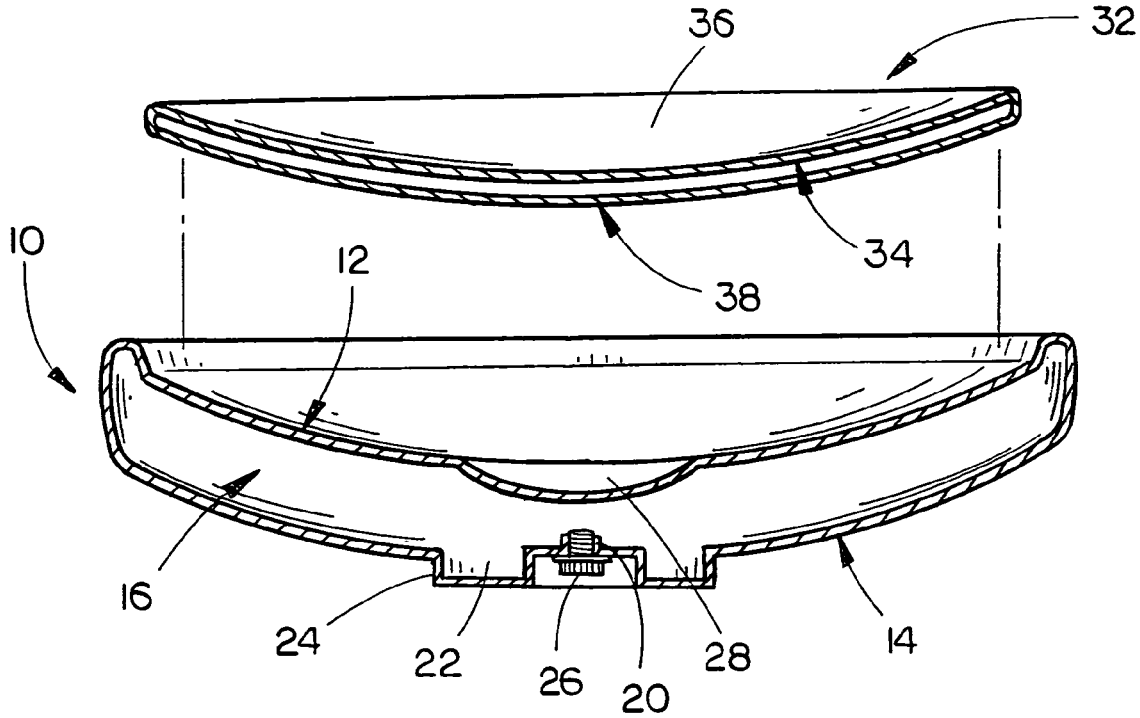
FIG. 5 is a cutaway side elevation view of another embodiment of the food container and corresponding lid/tray of the present invention.

A lid 32, as depicted in FIGS. 5, 7 and 8, can be provided for use with the container 10. It is contemplated that the lid 32 could be formed from a solid or partially hollow material to provide a certain degree of insulation to the food when the lid 32 is operatively engaged with the container 10 as depicted in FIG. 8. However, it is also contemplated that the lid 32 could be provided with a temperature storing medium 18 to fill the cavity 34 that is formed between the lower surface 36 and upper surface 38. In this manner, the temperature storing medium 18 would serve much the same purpose as described previously when used within the chamber 16 of the container 10. It is preferred that a sufficient expansion zone be provided within the chamber 34 to prevent rupturing the lid. Likewise, it is contemplated that an opening could be formed at a location along the lower surface 36 or the upper surface 38 to enable the user to insert or remove the temperature storing medium 18 in or from the chamber 34.

It is preferred that the lid 32 be shaped so that it may be reversed from its typical orientation depicted in FIG. 8 and be used as a serving platter, wherein the lower surface 36 is positioned upwardly as depicted in FIGS. 5 and 7. To this end, the lower surface 36 may be formed to have a plurality of shapes and depressions 40 to hold food, bowls, and the like. Using the lid 32 as a serving platter further serves to protect food from becoming too hot or too cold due to the temperature of the temperature storing medium 18 within the container 10. For example, where shrimp are placed on the lower surface 36 of the lid 32, and the lid 32 is positioned closely adjacent the inner portion 12 of the shell, the shrimp will not become too cold or frozen if the temperature storing medium 18 within the container 10 was frozen. Accordingly, the insulative properties of the lid 32 serve a dual function.

When cooling or heating the container 10 in an appliance that is too small, overcrowded or configured awkwardly, the container may be provided in a plurality of separate portions. Although it is contemplated that virtually any number of separate container portions could be provided to couple with one another, the container 10' is generally depicted as having a first portion 42 and a second portion 44. The first portion 42 and the second portion 44 are generally depicted as being similar in size and shaped to have matable configurations. However, it is contemplated that the separate portions could be of unequal size; and some separate portions may be of similar, if not exact, configuration depending on the particular application. Regardless of the configuration or the number of separate portions, it is preferred that each of the separate portions function much in the same way as the container 10, as described previously. For example, each of the separate portions will be comprised of a shell having an inner portion 12' and an outer portion 14', which will be spaced from one another to form an individual chamber 16'. An opening 20' can be formed in the shell of each separate portion to permit the user to introduce a temperature storing medium 18 to the chamber 16'. A cap means 26' or 26" can be provided to selectively close the opening 20'. The opening 20' is preferably placed at a location on the shell to form an expansion zone 22'", which preferably remains substantially devoid of any temperature storing medium 18 until the user has completed filling the chamber 16'. Each of the separate portions may be provided with a support 24' to provide a base on which the container 10' may be placed. When desired, the support 24' may be provided to be expandable in a manner similar to that depicted in FIGS. 7 and 8.

Figure 9:
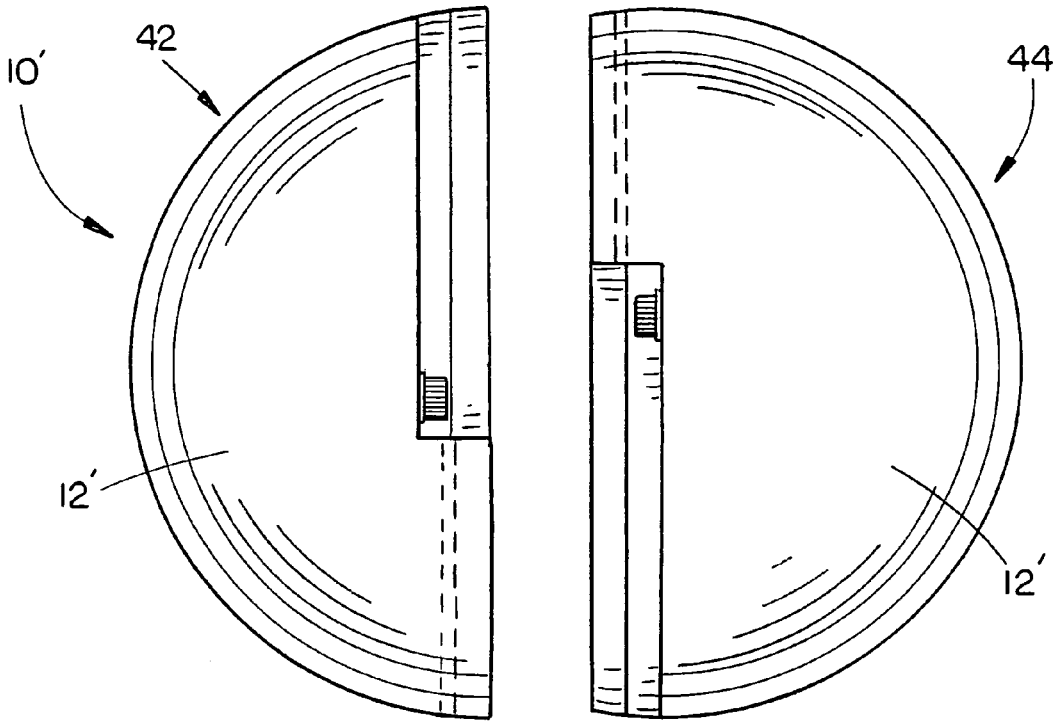
FIG. 9 is a top view of an alternate embodiment of the food container of the present invention.
Figure 10:
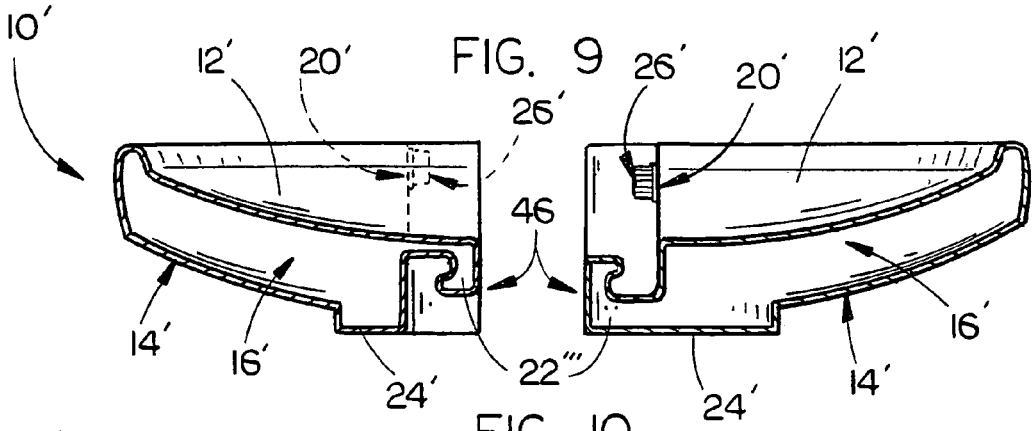
FIG. 10 is a cutaway side elevation view of the food container of FIG. 9.
Figure 11:
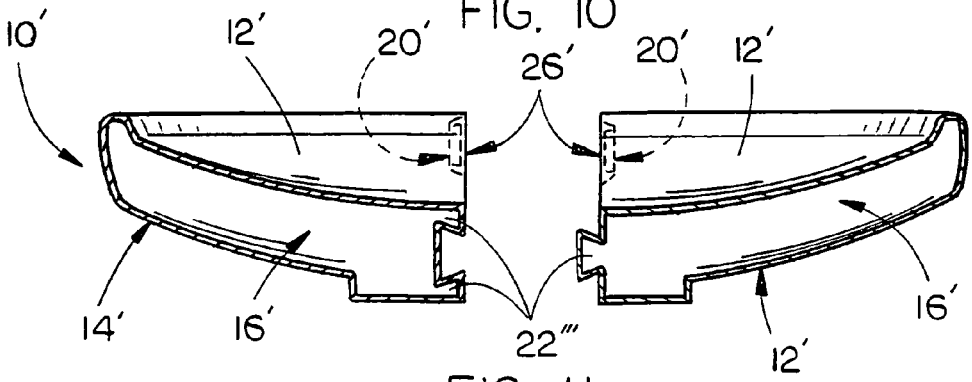
FIG. 11 is a cutaway side elevation view of an alternate embodiment of the food container of the present invention.

It is preferred that each of the separate portions be provided with a mating surface 46, which is selectively and removably engageable with a mating surface 46 from another separate portion. In this manner, the separate portions are made into the container 10'. The mating surfaces 46 are preferably provided with a locking means for securing opposing separate portions to one another. Two examples of such a locking means are depicted in FIGS. 10 and 11. FIG. 10 depicts a pair of interlocking lip members that can be positioned adjacent one another and slid into a locking position. Where this interlocking method is incorporated, it is preferred that the inner portion 12' be shaped accordingly to complete a surface for supporting the food when the opposing separate portions are coupled with one another, an example of which is depicted in FIG. 9. FIG. 11 depicts an alternate embodiment of an interlocking means which utilizes a dovetail system having a pin and socket mechanism that interlock when the pin is slid within the socket. However, other interlocking structure such as a push pin and socket assembly could be used.

In the drawings and in the specification, there have been set forth preferred embodiments of the invention; and although specific items are employed, these are used in a generic and descriptive sense only and not for purposes of limitation. Changes in the form and proportion of parts, as well as substitution of equivalents, are contemplated as circumstances may suggest or render expedient without departing from the spirit or scope of the invention as further defined in the following claims.

Thus it can be seen that the invention accomplishes at least all of its stated objectives.

What is claimed is:

1. A food container, comprising:

a shell having an inner portion and an outer portion operatively coupled to said inner portion;

said inner portion being shaped to hold food;

said outer portion being spaced from said inner portion to form a chamber having a volume for holding a temperature storing medium;

said shell being shaped to define an expansion zone within said chamber which is sized and shaped to receive expanded portions of said temperature storing medium caused by a change in temperature within said temperature storing medium;

said shell is selectively separable into a plurality of separate shell portions; said plurality of separate shell portions comprising a portion of the inner and outer portions of said shell;

said expansion zone being expandable to increase the capacity of said chamber.

2. The food container of claim 1 further comprising an opening formed within said shell to permit the selective insertion or removal of said temperature storing medium within or from said chamber.

3. The food container of claim 2 further comprising cap means for selectively closing said opening within said shell.

4. The food container of claim 2 wherein said opening is formed at a location within said shell that substantially prevents said temperature storing medium from entering said expansion zone while said temperature storing medium is being inserted within said chamber.

5. The food container of claim 2 wherein said outer portion of said shell is shaped to have a support structure extending outwardly from said shell.

6. The food container of claim 5 wherein said support structure forms a portion of the volume of said chamber.

7. The food container of claim 6 wherein said portion of the volume of said chamber formed by said support structure defines at least a portion of said expansion zone.

8. The food container of claim 1 wherein said plurality of separate shell portions is provided with an inner chamber that is adapted for holding the temperature storing medium.

9. The food container of claim 1 wherein a portion of said expansion zone is provided within the inner chamber of each of said separate shell portions.

10. The food container of claim 9 wherein each of said plurality of separate shell portions are provided with a mating surface that is operatively releasably engageable with a mating surface of another of said plurality of separate shell portions.

11. The food container of claim 10 further comprising locking means for releasably locking the mating surfaces of said plurality of separate shell portions to one another.

12. The food container of claim 10 wherein the outer portion of said shell is shaped to have a support structure extending outwardly from said shell;

said support structure forming at least a portion of said expansion zone.

13. A food container, comprising:

a shell having an inner portion and an outer portion operatively coupled to said inner portion;

said inner portion being shaped to hold food;

said outer portion being spaced from said inner portion to form a chamber having a volume for holding a temperature storing medium;

said shell being shaped to define an expansion zone within said chamber which is sized and shaped to receive expanded portions of said temperature storing medium caused by a change in temperature within said temperature storing medium;

said shell is selectively separable into a plurality of separate shell portions; said plurality of separate shell portions comprising a portion of the inner and outer portions of said shell;

a portion of said expansion zone being provided within the inner chamber of each of said separate shell portions;

each of said plurality of separate shell portions being provided with a mating surface that is operatively releasably engageable with a mating surface of another of said plurality of separate shell portions;

the outer portion of said shell being shaped to have a support structure extending outwardly from said shell;

said support structure forming at least a portion of said expansion zone;

said support structure being expandable to create additional volume within said chamber.

14. A food container, comprising:

a shell having an inner portion and an outer portion operatively coupled to said inner portion;

said inner portion being shaped to hold food;

said outer portion being spaced from said inner portion to form a chamber having a volume for holding a temperature storing medium;

said shell being shaped to define an expansion zone within said chamber which is sized and shaped to receive expanded portions of said temperature storing medium caused by a change in temperature within said temperature storing medium;

said shell is selectively separable into a plurality of separate shell portions; said plurality of separate shell portions comprising a portion of the inner and outer portions of said shell;

a portion of said expansion zone being provided within the inner chamber of each of said separate shell portions;

each of said plurality of separate shell portions being provided with a mating surface that is operatively releasably engageable with a mating surface of another of said plurality of separate shell portions;

the outer portion of said shell being shaped to have a support structure extending outwardly from said shell;

said support structure forming at least a portion of said expansion zone;

said support structure automatically expanding in response to a pressure increase within said chamber.

* * * * *